United States Patent [19]

Young

[11] Patent Number: 4,822,380

[45] Date of Patent: Apr. 18, 1989

[54] COATED CARBONACEOUS MATERIAL

[76] Inventor: C. B. Fehrler Young, P.O. Box 796, Douglasville, Ga. 30133

[21] Appl. No.: 20,967

[22] Filed: Mar. 3, 1987

[51] Int. Cl.[4] ..... C10L 5/32

[52] U.S. Cl. ..... 44/544; 44/542; 44/545; 44/600; 44/642

[58] Field of Search ..... 44/6, 41, 544, 642, 44/533, 542, 543, 544, 545, 600, 603

[56] References Cited

U.S. PATENT DOCUMENTS

| | | | |
|---|---|---|---|
| 1,617,996 | 2/1927 | Ellis | 44/6 |
| 1,991,872 | 2/1935 | Snell et al. | 44/6 |
| 2,139,398 | 12/1938 | Allen | 44/642 |
| 2,176,127 | 10/1939 | Fife | 44/6 |
| 2,222,945 | 11/1940 | Groll, Jr. et al. | 44/6 |
| 2,381,891 | 8/1945 | Elkan | 44/6 |
| 2,822,251 | 2/1958 | Swinehart et al. | 44/542 |
| 2,842,431 | 7/1958 | Robertson | 44/544 |
| 2,854,347 | 9/1958 | Booth et al. | 44/6 |
| 3,370,932 | 2/1968 | Kelly et al. | 44/642 |
| 3,431,093 | 3/1969 | Kreinik | 44/542 |
| 3,647,403 | 3/1972 | Davis, Jr. | 44/544 |
| 4,421,520 | 12/1983 | Matthews | 44/6 |

FOREIGN PATENT DOCUMENTS

| | | | |
|---|---|---|---|
| 558149 | 6/1958 | Canada | 44/6 |
| 621187 | 5/1961 | Canada | 44/542 |
| 1256264 | 12/1971 | United Kingdom | 44/544 |

*Primary Examiner*—Carl F. Dees

*Attorney, Agent, or Firm*—James B. Middleton

[57] ABSTRACT

A clean and attractive carbonaceous fuel product is provided for improved convenience and marketability. Coal or charcoal can be coated with a clean and durable coating for cleanliness in handling; and, the coating can be colored as desired. Further, a metal salt can be added to the coating or the product itself to color the flame while the product burns. Paraffin can be used as the coating, and the paraffin is maintained above its melting point to improve gloss. Other additives can also improve gloss. Coal is preferably coated with latex to provide an attractive coating that will prevent breaking of the coal. A flammable liquid can be incorporated into charcoal briquettes for easier lighting; and, the liquid reduces the amount of paraffin used in the coating. A masking agent hides the odor of the flammable liquid, the masking agent being in the coating rather than in the flammable liquid itself.

16 Claims, No Drawings

COATED CARBONACEOUS MATERIAL

INFORMATION DISCLOSURE STATEMENT

Carbonaceous materials are well known as burnable substances both for cooking and for heating. In the context of heating, it is well known that many people currently use a fireplace or the like merely for decorative purposes. Because of the availability of appliances whereby a fireplace can be substantially enclosed and utilized as a reasonably sophisticated heating unit, it is not uncommon for a fire to be used both for heating a living space, and for decorative purposes.

It is also very common to utilize barbecue grills, hibachi and the like for cooking. Charcoal is the preferred fuel because of the lack of an active flame, the cooking being done preferably by the radiant heat easily derived from a charcoal product.

One of the conventional problems with all of the carbonaceous fuel products is that the products are relatively easily broken. Thus, if a person buys a bag of coal or charcoal, there will be a considerable number of small pieces that will burn very quickly. In addition, when a piece of carbonaceous fuel breaks, it will be understood that there will normally be a considerable amount of dust and fragments, which is effectively waste for purposes of fuel, but also renders the fuel product very messy to deal with. While a charcoal briquette is a manufactured product that is compressed and has some fair degree of coherence, conventional coal and the like is relatively easy to break, and generally includes a substantial quantity of coal dust, or soot.

In view of these various problems, there have been several efforts to coat a charcoal product, the coating normally being with a wax material such as a paraffin. Paraffin has frequently been chosen because of the lack of toxicity of the material, the ease of handling the material, and the combustibility of the material. Paraffin coatings have previously been used both as a means to prevent the dustiness of charcoal and as a means to assist in lighting the charcoal. It will be understood, however, that paraffin does not have great strength, and the charcoal will still be reasonably breakable. Furthermore, carbonaceous fuels tend to burn with a yellow flame, and there is very little general variation in the flame coloring so that the decorative aspect of fireplaces has been achieved by elaborate andirons, fireplace facings and the like.

SUMMARY OF THE INVENTION

This invention relates generally to coated carbonaceous fuel products, and is more particularly concerned with a clean, attractive and durable fuel product formed from carbonaceous materials.

The present invention provides a carbonaceous fuel product having a clean and shiny or glossy surface for customer appeal in purchasing the product. Further, the carbonaceous fuel product is clean to handle, and is without the usual dust, soot or fragments associated with carbonaceous fuel products. The coating in all cases is reasonably easy to ignite for an efficient fuel product, and in some embodiments of the invention may include a further easily burnable material to assist in initial lighting of the product.

One form of the fuel product of the present invention will utilize a transparent coating so that the carbonaceous fuel product appears to be the normal black color, but with a clean, reflective and glossy surface. Other forms of the invention can include substantially opaque coatings, the coatings either being white or having various colors added by appropriate dye materials or the like. Further embodiments of the present invention include chemical additives so that, as the fuel product burns, the flame will have a definite color caused by the burning of the additive.

DETAILED DESCRIPTION OF THE EMBODIMENTS

Considering the invention in more detail, it will be understood that the present invention can be utilized with virtually any carbonaceous fuel product, and the following detailed description will elucidate the applicability to various types of products. By way of example, the following specification will deal with anthracite and bituminous coal, and with conventional, hardwood, charcoal.

In general, coal or charcoal can be coated with paraffin to render the carbonaceous product clean and easy to light. Those skilled in the art will be aware that paraffin is available with varous melting points. With this in mind, a low melting point paraffin is highly desirable as a coating because the low melting point paraffin has a lower flash point, and the carbonaceous product will be easier to light. It has been found, however, that the higher the melting point of the paraffin, the higher and glossier is the coating. A paraffin of 160° melting point is desired. Also, the temperature of the paraffin dip should be 60° F. above its melting point. Thus, for paraffin with a melting point of 160° F., the temperature of the dip should be in the neighborhood of 195° F. to 220° F.

If the usual, hereindescribed process does not yield sufficient shininess for the product, there are some additives that have been discovered to increase the gloss. It is possible to increase the brightness by adding monocrystalline wax to the 160° F. melting point paraffin. Also, it has been found that the addition of polyethylene or a stearic amide to the paraffin greatly increases the gloss. In using the polyethylene and stearic amide, the additives should amount to 0.5 to 2% by weight of the paraffin.

Additionally, it has been found that charcoal is conventionally stored in warehouses and the like at a reltively high ambient temperature, which results in a quite short shelf-life for the fuel product coated with a low melting point paraffin. While a high melting point paraffin will yield a longer shelf life, the paraffin, hence the fuel product, will be more difficult to light. Thus, it has been found that the use of a paraffin that melts at about 160° F. is an optimum product. Also, to increase the ease in lighting without adversely affecting the shelf-life, as much as 30% of paraffin having a 140° melting point can be added to the flammable liquid discussed below.

In considering the coating of charcoal, paraffin is desirable because of the relatively hard and clean coating provided on the outside of the fuel product. Nevertheless, paraffin is somewhat expensive, so a large quantity of paraffin added to the charcoal will result in a high manufacturing cost and consequently a high sale price. It has been found that a good coating of paraffin can be achieved, sufficient to render the fuel product easy and clean to handle, with a smaller coating of paraffin.

The charcoal can be placed in a revolving drum and air blown over it to remove the fine dust and the like. If necessary, the charcoal may be heated to a temperature of about 125° to 130° F. to reduce the water content to 5 to 8%, and to reduce the difference in temperature between the temperature of the briquette and the temperature of the dip to 70° to 80° F.

After the charcoal has been dried, if necessary, to the desired moiture content, the charcoal is dipped into a flammable product, such as the commonly available fuels listed below, for 15 to 30 seconds. The specified time for soaking the charcoal in the fuel is not critical, though the time should of course be kept as short as possible to maintain high production levels, and it has been found that immersion for a period of 15 to 30 seconds is adequate. In this time, the fuel such as JP4 is both absorbed and adsorbed into the fuel product so that the fuel amounts to approximately 7 to 12% of the product by weight.

In order to decrease the loss of the flammable liquid, it has been found that a low meting point paraffin can be added to the flammable liquid. The amount required varies from 10 to 30% of paraffin having a melting point of 120° F. This paraffin product can be added to either of the flammable liquids mentioned below.

Those skilled in the art will realize that the liquids are substantially light kerosene products. A precise definition of the product is provided by the following table showing the boiling points for the initial fractions and subsequent percentages of the material:

| | |
|---|---|
| Initial Boiling Point | 140° F. |
| 10% | 210° F. |
| 20% | 250° F. |
| 30% | 274° F. |
| 40% | 296° F. |
| 50% | 304° F. |
| 60% | 338° F. |
| 70% | 357° F. |
| 89% | 381° F. |
| 90% | 416° F. |
| End Point | 498° F. |

The above described product has a density of 6.37 pounds per gallon.

Another petroleum cut which can be used has the initial boiling point of 370° F. and is as follows:

| | |
|---|---|
| Initial Boiling Point | 370° F. |
| 10% | 410° F. |
| 20% | 421° F. |
| 30% | 426° F. |
| 40% | 428° F. |
| 50% | 439° F. |
| 60% | 447° F. |
| 70% | 456° F. |
| 80% | 468° F. |
| 90% | 494° F. |
| 95% | 527° F. |
| End Point | 562° F. |

The latter product has a density of 6.68 pounds per gallon. When the charcoal is dipped in the liquid, the liquid fills the interstices in the charcoal. After the immersion in the liquid, the charcoal is removed and allowed to rest for about 5 to 20 minutes, or just sufficient time for the surface of the charcoal to become dry. Following this delay, the charcoal is retained at ambient temperature or raised to 125° to 130° F., and is immersed in paraffin that is maintained at a temperature of from 195° to 220° F. The charcoal is allowed remain in the paraffin for time a period of 15 to 30 seconds.

As long as the paraffin is in a liquid state the charcoal can be dipped into the paraffin and the charcoal will be coated. It has been found, however, that by keeping the paraffin at a temperature between 195° and 220° F. the resulting coating is relatively thin and has a gloss or brilliance that has great aesthetic appeal. This is assuming that the briquettes are at ambient to 130° F. temperatures. If the briquettes are elevated the temperature of the paraffin can be 200° to 215° F. Specifically, it has been found that if the charcoal is dipped into paraffin without the benefit of the prior dip into the flammable liquid, the charcoal will retain about 6 to 7% of paraffin by weight. On the other hand, when the charcoal is first dipped into flammable liquid as described above, then dipped into the paraffin, the paraffin is reduced to about 3 to 4% by weight of the charcoal. Thus, utilizing the above described procedure the cost of the charcoal product is lower and the saleability greatly enhanced. It will also be recognized that the presence of the flammable liquid within the charcoal will make the charcoal easier to light throughout so that the coals will be ready to use more quickly.

One of the objections of using a flammable or fast burning product to aid in lighting the charcoal has been the odor produced by the presence of the product. In this case a masking agent can be added to the flammable product thereby eliminating this problem. Furthermore, in this particular instance if the masking agent is added to the paraffin, the odor masking is accomplished with an economical advantage as it requires less of the masking agent if added to the paraffin.

While the above discussion has recited charcoal in particular, it should be recognized that the paraffin coating can be placed on coal or other carbonaceous fuels utilizing the same technique. However, in the event anthracite or bituminous coal is being coated, it will be recognized that the paraffin is not sufficiently strong to prevent breakage of the coal on severe impact. Charcoal briquetts, being a man-made, compressed product, have greater cohesiveness than coal, and coal is relatively easy to fracture along natural grain boundaries. While the paraffin coated coal will be clean and attractive, large menchanical forces will still fracture the coal and expose the interior.

In view of the delicate nature of coal, paraffin does not provide an ideal coating. Efforts to produce a highly desirable coal product eventually revealed the use of latex as a coating.

Those skilled in the art will realize that latex is flammable so the coating itself is burnable along with the fuel product. While a commercially available form of latex is substantially opaque, it will be understood opacity is provided by additives such as calcium carbonate or titanium dioxide. Pure latex dries to a generally clear, transparent coating. Thus, for a fuel product that looks very much like conventional coal, but has the appealing high gloss, and the highly desirable cleanliness, the conventional hard coal or bituminous coal can be coated with clear latex.

If the latex is too highly viscous, the coal will retain a greater quantity of latex than is desirable; and, if the latex is too thin or watery, the coal will not retain enough latex for an adequate coating. It has been found that the latex should have at least about 45% solids, and preferably no more than about 55% solids. This appears to be the optimum range, the latex being suspended in water as an emulsion. Given the aqueous emulsion having 45 to 55% solids, anthracite or bituminous coal is immersed in the liquid, and is soaked for 30 to 60 seconds. The coal is removed from the latex and allowed to dry. It is obvious that lesser amounts can be used if desired.

In drying of the latex-covered coal, it is important to realize that the pieces of coal should be supported by fingers, or points, so that air can reach all sides of the coal product. If the coated coal is placed on a flat surface, latex will drain from the surface of the coal and create a puddle at the bottom of the piece. When the piece of coal is subsequently lifted from the surface, either the puddle of latex will release from the surface producing a large glob of latex attached to the piece of coal, or the puddle will adhere to the flat surface and pull the coating from the bottom of the piece of coal. Draining the coal on points, or fingers, will resolve this difficulty and allow the piece of coal to be evenly coated.

After this treatment, it has been found that a piece of standard hard coal has a bright, shiny coating and can be handled without transferring dirt or soot. Further, and very importantly, the piece of coal can be dropped from a distance of about 7 feet to a concrete surface, and the coal will not shatter.

A carbonaceous fuel product made in accordance with the above described techniques is a highly marketable and very desirable product, the carbonaceous product being easy to light, convenient to handle, and generally maintaining its integrity. The present invention further provides, however, that the above described products can be made more appealing from a marketing standpoint by certain additions to the coatings.

It should first be mentioned that, when a carbonaceous fuel product is to be used for cooking food, conventional regulations must be observed, and some of the additives mentioned below may not be acceptable. Any additive with no human toxicity can be used in heating products or cooking products. For the additives that do have some human toxicity, it will be understood that the additives are usable only in heating products.

While the above described products include a transparent coating so that the black color of the natural product shows through, this usual clarity can be removed by certain fillers to render the coating opaque. Two conventional fillers are calcium carbonate ($CaCO_3$) and titanium dioxide ($TiO_2$). Both these products will render the coating opaque, with a white appearance. Furthermore, it will be understood that either the calcium carbonate or the titanium dioxide can be added to both latex and paraffin to render the coatings white and opaque.

Once the opaque, white coating has been achieved, it will be readily recognized that various colorings can be added to achieve various hues. Such coloring materials as conventional food dyes can be mixed into the coating material to achieve virtually any color in the rainbow.

It will therefore be understood that the conventional carbonaceous fuel products can be coated for cleanliness, and can be colored for various purposes, including colorings for particular seasons such as orange and black for Hallowe'en, red and green for Christmas and the like. Also, it will quickly be recognized that school colors can be used, or colorings for any other purpose.

One further decorative step is in the production of colored flames as the fuel product burns. While charcoal exhibits little flame while in normal use, it will be realized that the product exhibits a substantial flame during the lighting process; therefore, the flame-coloring material may be added to the coating so that the charcoal will exhibit colored flames while being lighted, even though the flame disappears during most of the consumption of the charcoal.

On the other hand, coal tends to exhibit some flame throughout its useful life, soft coal having substantial flame while hard coal has little. Thus, colored flames produced from coal could be enjoyed for an extended period.

It is known that various metal salts burn with specific colors of flames. It is therefore contemplated that various metal salts will be added to the fuel product to achieve the desired flame color. By way of example, strontium chloride ($SrCl_2$) burns with a red flame, cupric chloride ($CuCl_2$) burns with a blue flame, sodium borate ($Na_2B_4O_7$) burns with a green flame, and potassium chloride (KCl) burns with an orange-red flame. These salts are given by way of example, but those skilled in the art will recognize that any metal salt or other additive that will yield a colored flame can be used for the desired color.

To place the metal salt in the fuel product, the salt may be added to the coating so that, as the coating burns, the flame will be the desired color. Alternatively, in the case of charcoal, the metal salt can be added to the material at the time the briquette is made so the briquette will burn with the desired color. Also, small holes can be drilled into either charcoal or coal, and the hole filled with a dry form of the appropriate additive. In the event the fuel product is provided with holes, and the holes filled with the additive, the fuel product will be coated as described above after the salt has been introduced into the product.

One further step, considering the above discussion, is to provide the colored coating for the fuel product, and to introduce the appropriate metal salt so that the flame produced by the fuel product will be the color of the coating on the fuel product. With this arrangement, a person can buy red charcoal, and achieve a red flame, or green charcoal and achieve a green flame, etc.

From the above discussion, it will be realized that the present invention provides a coating for carbonaceous fuel products, the coating rendering the fuel product clean and easy to handle, and more durable than is normal. A basic, clear coating will render the fuel product attractive and easy to handle while reducing waste and allowing the product to be sold in bulk for individual selection by the customer if desired, and additives are disclosed to increase the gloss for a more attractive product. In the case of charcoal the fuel added makes the briquette fast lighting. A further aspect of the invention includes the coloring of the fuel products by rendering the coating opaque through the use of appropriate fillers. The addition of conventional dyes and the like then can make the fuel product any desired color. Further, additives such as metal salts may be introduced into the flammable product itself and/or into the coating for the fuel product so the fuel will burn with a flame of a selected color.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A coated fuel product comprising a piece of charcoal, and a glossy coating of paraffin completely enclosing said piece of charcoal, said charcoal further including a flammable liquid therein, said flammable liquid consisting of a light kerosene product and being sealed within said charcoal by said coating, said coating of paraffin consisting of from about 3 percent to about 7 percent by weight of said fuel product, and said flammable liquid consisting of from about 7 percent to 12 percent by weight of said fuel product.

2. A coated fuel product as claimed in claim 1, and including a masking agent for masking the odor of said flammable liquid, said masking agent being mixed into said coating of paraffin.

3. A coated fuel product as claimed in claim 1, and further including means for causing a flame to have a selected color consisting of a metal salt incorporated into said charcoal.

4. A coated fuel product as claimed in claim 1, and further including an additive for increasing the gloss of said coating, said additive being selected from the group consisting of polyethylene, stearic amide and monocrystalline wax.

5. A coated fuel product comprising a piece of carbonaceous material, and a coating completely enclosing said material for maintaining the physical integrity of said material, said carbonaceous material consisting of coal, said coating consisting of latex.

6. A coated fuel product as claimed in claim 5, and further including an additive in said coating for rendering said coating somewhat opaque and of a selected color.

7. A coated fuel product as claimed in claim 6, and further including a dye in said coating for rendering said coating a selected color.

8. A coated fuel product as claimed in claim 7, and further including means for rendering a flame supported by said fuel product a selected color.

9. A coated fuel product as claimed in claim 8, said means for rendering a flame a selected color comprising a metal salt, said selected color of said flame being the same as said selected color of said coating.

10. A method for providing a coated fuel product, wherein said fuel product is charcoal and the coating completely encloses said charcoal, said method including the steps of removing loose particles from said charcoal by blowing air over said charcoal, immersing said charcoal in a flammable liquid comprising a light kerosene product for a period of time in the range from 20 to 30 seconds, allowing excess flammable liquid to drain from said charcoal, and subsequently immersing said charcoal in melted paraffin having a melting point of about 160° F., while maintaining the temperature of said paraffin to be above the melting point of said paraffin by around 60° F. so that the temperature of said paraffin is in the range of 195° to 220° F.

11. A method as claimed in claim 10, and further including the steps of adding a filler to said paraffin for rendering said coating generally opaque.

12. A method as claimed in claim 11, and including the step of adding a metal salt to said charcoal prior ot said step of removing loose praticles from said charcoal.

13. A method as claimed in claim 11, and further including the step of adding an additive selected from the group consisting of polyethylene, stearic amide and monocrystalline wax, said additive serving to increase the glossiness of the coating.

14. A method for providing a clean coal product including the steps of removing loose particles of coal from said coal product, immersing said coal product in an aqueous emulsion of latex including from about 45% solids to about 55% solids, said latex being substantially at ambient temperature, removing sid coal product from said latex and supporting said coal product to allow latex adhering to said coal product to dry.

15. A method as claimed in claim 14, wherein the said step of supporting said coal product comprises the step of supporting said coal product on a plurality of points for preventing puddling of said latex on said coal product.

16. A method as claimed in claim 15, and further including the step of adding a filler to said aqueous emulsion of latex prior to the said step of immersing said coal product for rendering said latex generally opaque.

* * * * *